US005462572A

United States Patent [19]

Tallbäck

[11] Patent Number: 5,462,572

[45] Date of Patent: Oct. 31, 1995

[54] METHOD AND A DEVICE FOR STIRRING A MOLTEN METAL

[75] Inventor: Göte Tallbäck, Västerås, Sweden

[73] Assignee: Asea Brown Boveri AB, Vasteras, Sweden

[21] Appl. No.: 362,600

[22] PCT Filed: Jun. 23, 1993

[86] PCT No.: PCT/SE93/00556

§ 371 Date: Jan. 11, 1995

§ 102(e) Date: Jan. 11, 1995

[87] PCT Pub. No.: WO94/03294

PCT Pub. Date: Feb. 17, 1994

[30] Foreign Application Priority Data

Aug. 7, 1992 [SE] Sweden ..... 9202308

[51] Int. Cl.[6] ..... B22D 1/00

[52] U.S. Cl. ..... 75/10.16; 266/234

[58] Field of Search ..... 266/234, 242, 266/200, 237; 75/10.14, 10.16

[56] References Cited

U.S. PATENT DOCUMENTS

| | | | |
|---|---|---|---|
| 3,162,710 | 12/1964 | Anderson | 266/242 |
| 3,230,073 | 1/1966 | Ericsson | 75/10.16 |
| 3,314,670 | 4/1967 | Kennedy | 266/234 |
| 4,183,508 | 1/1980 | Michelet et al. | 266/242 |
| 5,164,148 | 11/1992 | Kawasaki | 266/242 |

*Primary Examiner*—Scott Kastler

*Attorney, Agent, or Firm*—Watson, Cole, Grindle & Watson

[57] ABSTRACT

A method and a device for inductively stirring a molten metal. Magnetic fields are applied to act on the melt through a wall (11) which comprises a magnetic material. Said wall is saturated by a magnetic direct field such that an anisotropically directed magnetic saturation, a low relative permeability, is obtained in the saturation direction (S). A low-frequency magnetic travelling alternating field, comprising components which are located in a plane oriented parallel to said saturation direction and perpendicular to the plane of the wall, is applied superposed on the magnetic direct field, whereby the low-frequency magnetic travelling alternating field passes through said wall with small losses and little damping to apply a stirrer field which provides the desired circulation in the melt.

11 Claims, 1 Drawing Sheet

METHOD AND A DEVICE FOR STIRRING A MOLTEN METAL

TECHNICAL FIELD

The invention relates to a method and a device for stirring a molten metal. More specifically, the invention relates to inductive stirring of a molten metal which is contained in a container with a wall, which comprises at least one layer of a magnetic material.

BACKGROUND ART

To bring about homogenization and temperature equalization in a melt and to improve reaction conditions in connection with refining, degassing and alloying of the melt, the melt is stirred. By allowing a low-frequency magnetic travelling alternating field to act on the molten metal, sufficient electromagnetic forces are generated in the melt to achieve a good and controllable circulation in the melt. This circulation stirs the melt such that the desired improvements regarding homogenization and reaction conditions are achieved.

During the treatment, the melt is contained in a container, preferably an essentially cylindrical ladle or crucible, and a low-frequency magnetic travelling alternating field, which is generated in a coil arranged outside the container, is applied to the melt.

A problem which arises when a magnetic alternating wall is applied to act through a container wall are the losses which occur in the wall, especially when the wall comprises a magnetic material.

Usually, this problem is solved by designing at least that part of the container wall, through which the low-frequency magnetic alternating field has to pass to act on the melt, of a non-magnetic material. Especially in connection with ladles in which a molten metal is contained during transport, refining, degassing, alloying, holding and/or casting, this leads to increased costs because conventional steels cannot be used for that part of the shell of the ladle through which the magnetic alternating field is applied.

One object of the invention is to suggest a method, in inductive stirring of a melt, of applying a low-frequency magnetic travelling alternating field to act through a wall, which comprises at least one layer of a magnetic material.

Another object of the invention is to suggest a device suitable for inductively stirring a melt contained in a container whose walls comprise at least one layer of a magnetic material.

SUMMARY OF THE INVENTION

When a molten metal, which is contained in a container, is stirred inductively, magnetic fields are applied which, in order to act on the melt, must pass through the wall of the container.

During inductive stirring according to the invention, the above-mentioned container wall comprises at least one layer of a magnetic material. To thereby inductively stir the melt, at least one magnetic direct field is applied to act on part of the wall of magnetic material, such that an anisotropically directed magnetic saturation—a low relative permeability—is obtained in that part of the wall, in a direction—the saturation direction—which is substantially oriented in the plane of the wall and essentially parallel to the desired stirrer direction in the melt. According to the invention, a low-frequency magnetic travelling alternating field is further applied superposed on the magnetic direct field. This magnetic alternating field comprises components, which are substantially located in a plane oriented parallel to the saturation direction and perpendicular to the plane of the wall. The low-frequency alternating field thus passes through the part of the wall which is magnetically saturated by the direct field, with small losses and a low damping, whereby sufficient electromagnetic forces, in the form of a stirrer field, are generated in the molten metal to provide the desired circulation.

The above-mentioned method of stirring a molten melt is achieved by means of a device which according to the invention comprises at least

- a container for a molten metal, in which the wall of the container comprises at least one layer of a magnetic material,
- a device which generates a magnetic direct field in the form of at least one coil supplied with direct current or a permanent magnet, wherein the magnetic direct field is adapted to act on the magnetic material in the wall and to bring about an anisotropically directed magnetic saturation in one part of the wall, in a direction, the saturation direction, which is substantially oriented in the plane of the wall and directed essentially parallel to a desired stirrer direction,
- a device which generates a low-frequency magnetic travelling alternating field, in the form of a plurality of coils, supplied with low-frequency alternating current, wherein the magnetic travelling alternating field is adapted to comprise components which are substantially located in a plane oriented parallel to said saturation direction and perpendicular to the plane of the wall, whereby the alternating field passes through the saturated part of the wall with small losses and little damping. The alternating field generates electromagnetic forces in the form of a stirrer field in the molten metal, which bring about a circulation directed essentially parallel to the saturation direction and perpendicular to the plane of the wall to stir the melt.

Preferably, according to the invention, a magnetic travelling alternating field with a frequency of between 0.1 and 5 Hz is applied to inductively stir the melt. This low-frequency magnetic alternating field is applied superposed on the magnetic direct field and thereby passes the part of the container wall, which is saturated by the direct field, with small losses and little damping.

In one embodiment of the invention, the melt is contained in an essentially cylindrical container, such as a ladle or a crucible furnace, where a circulation is desired which is substantially oriented in a plane with an essentially axial and radial extent in relation to the cylindrical container. A magnetic direct field is thereby applied to saturate a part of the wall of the cylindrical container in a direction which is substantially oriented in the plane of the wall and essentially axially directed. Superposed on the magnetic direct field there is applied a low-frequency magnetic travelling alternating field to act through the wall of the container and bring about sufficient electromagnetic forces in the melt to generate a circulation in the melt. The low-frequency magnetic alternating field essentially comprises axially and radially directed components which pass the container wall, saturated by the direct field, with small losses and little damping, such that the desired circulation is obtained in the melt.

The above-mentioned inductive stirring for a melt contained in an essentially cylindrical container is achieved by means of a device which comprises the cylindrical container with a wall which comprises at least one layer of a magnetic material, a device which generates a magnetic direct field which is applied to saturate the wall of the container in an essentially axial direction, and a device which generates a low-frequency magnetic travelling alternating field and this alternating field, which comprises essentially axially and radially directed components, is applied to act on the melt through the part of the container which is saturated by the direct field to bring about an essentially axially and radially directed circulation in the melt.

The magnetic direct field is generated by at least one coil supplied by direct current or a permanent magnet, arranged outside the container. This coil or permanent magnet is adapted to generate a magnetic direct field which is essentially axially directed in relation to the cylindrical container and which is applied to act on the magnetic material in the container wall to achieve an essentially axially directed magnetic saturation in a part of the container wall.

The low-frequency magnetic travelling alternating field is generated by at least one coil arranged outside the container and supplied with a low-frequency alternating current. This coil is adapted to apply a low-frequency magnetic travelling alternating field with essentially axially and radially directed components. The alternating field passes the part of the wall, which is saturated by the magnetic direct field, with small losses and little damping and generates electromagnetic forces in the form of a stirrer field in the melt. This stirrer field brings about the desired circulation in the melt.

In a preferred embodiment, the cylindrical container is arranged in the form of a ladle, in which a molten metal is stirred in connection with transport, refining, degassing, alloying, holding, or casting.

It is also possible to arrange this container in the form of a crucible furnace with a crucible which comprises a layer of a magnetic material, a magnetic direct field being applied to saturate a part of the crucible wall, and to apply a magnetic travelling alternating field superposed on the magnetic direct field to act through the magnetically saturated part of the crucible wall to stir a molten metal contained in the crucible.

BRIEF DESCRIPTION OF THE DRAWING

In the following the invention will be described in greater detail with reference to the accompanying figures, wherein.

DESCRIPTION OF THE PREFERRED EMBODIMENTS

Figure 1:
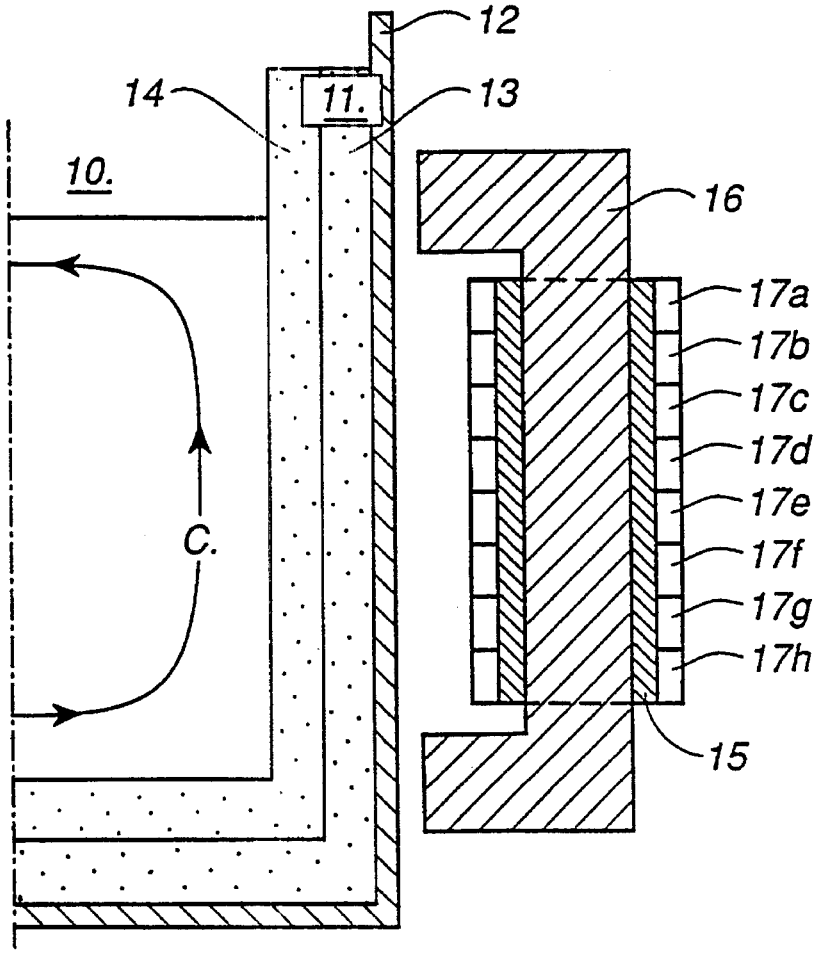
FIG. 1 shows stirring in a melt in which, according to the invention, a magnetic direct field is applied to a container wall which comprises a magnetic material, a low-frequency magnetic travelling alternating field being applied superposed on the direct field to stir a molten metal present in the container.

FIG. 1 shows a device for inductively stirring a molten metal. This molten metal is contained in a container 10, the wall 11 of which comprises at least one layer 12 of a magnetic material. Usually, such a wall 11 in a container for molten metals also comprises a thermally insulating lining layer 13, preferably of ceramic materials such as refractory bricks, as well as a protective layer 14, which reduce the lining wear. Preferably, these layers 13, 14 are made of ceramic materials with a composition and density chosen to minimize reactions with a molten metal 10, contained in the container, and any slag layer.

A magnetic direct field is applied to act on the molten metal by means of a device which generates a magnetic direct field, in FIG. 1 illustrated in the form of a coil 15 supplied with direct current and arranged around an iron core 16. The coil supplied with direct current may, however, be replaced by a permanent magnet. A low-frequency magnetic travelling alternating field is applied to the molten metal by a device which generates this alternating field, in FIG. 1 illustrated in the form of a plurality of coils 17*a–h*, which are supplied with low-frequency alternating current and are arranged around the same iron core 16 as the direct-current coil 15.

The above-mentioned magnetic direct field acts on the layer 12 of magnetic material in the wall 11 and brings about an anisotropically directed magnetic saturation in this layer 12. Magnetic saturation is obtained in a direction—the saturation direction S—which is substantially oriented in the plane of the wall and directed essentially parallel to a desired stirrer direction.

The magnetic travelling alternating field mentioned comprises components which are substantially located in a plane oriented parallel to the above-mentioned saturation direction S and perpendicular to the plane of the wall, whereby the alternating field passes the saturated part of the wall with small losses and little damping. Electromagnetic forces in the form of a stirrer field are thereby generated in the molten metal and bring about a circulation C directed essentially parallel to the saturation direction S and perpendicular to the plane of the wall to stir the melt. The alternating field mentioned has a frequency of between 0.1 and 5 Hz and is applied superposed on the magnetic direct field and thereby passes the part of the container wall 12 which is saturated by the direct field, with small losses and little damping.

Figure 2:
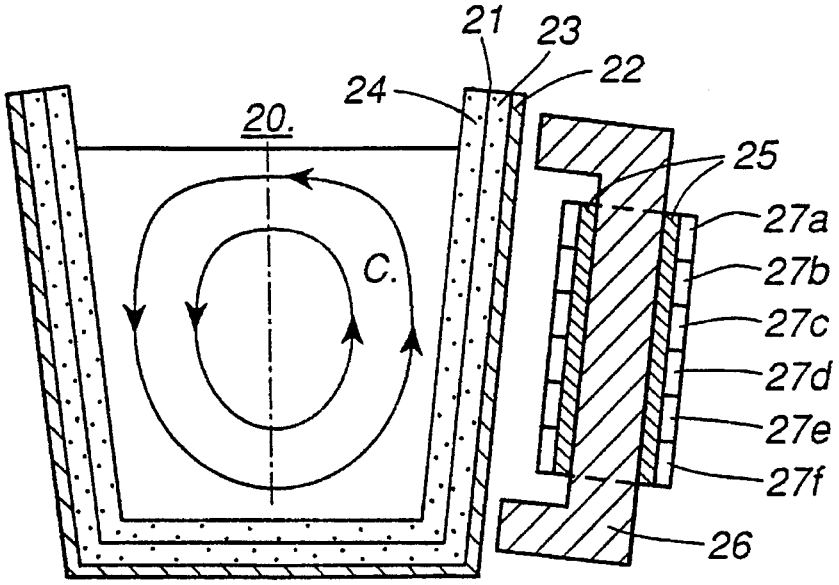
FIG. 2 shows the invention as applied to stirring in a ladle.

FIG. 2 shows the invention as applied to a melt contained in a ladle 20, in which the ladle wall 21 comprises at least one layer 22 of a magnetic material, preferably in the form of a ladle shell. A magnetic direct field is generated by a coil 25, arranged outside the ladle 20 around an iron core 26 and supplied with direct current, or by a permanent magnet arranged outside the ladle. This coil 25 or permanent magnet is adapted to generate a magnetic direct field, which is essentially axially directed in relation to the ladle 20 and is applied to act on the magnetic material in the ladle shell 22 to bring about an essentially axially directed magnetic saturation in a part of the shell 22.

The low-frequency magnetic travelling alternating field is generated by a plurality of coils 27*a–f*, arranged outside the ladle 20 around the same iron core 26 as the above-mentioned coil supplied with direct current, which coils are supplied with low-frequency alternating current. The coils 27*a–f* and the iron core 26 are adapted to apply a low-frequency magnetic travelling alternating field, with a frequency of 0.5 to 2 Hz and with essentially axially and radially directed components. The alternating field passes the part of the ladle shell 22 which is saturated by the magnetic direct field, with small losses and little damping, and generates electrodynamic forces in the form of a stirrer field, which provides the desired circulation in the melt.

In a preferred embodiment the above-mentioned ladle is intended to hold a molten metal in connection with transport, refining, degassing, alloying, holding, or casting.

I claim:

1. A method of inductively stirring a molten metal contained in a container having a wall with at least one layer of a magnetic material, comprising the steps of:

applying at least one magnetic direct field to at least part of said wall such that an anisotropically directed magnetic saturation is obtained in said part of the wall in the direction of saturation thereof and which is substantially oriented in the plane of the wall and essentially parallel to the desired stirring direction, applying a low-frequency magnetic travelling alternating field superposed on the magnetic direct field, said alternating field comprises components substantially located in a plane oriented parallel to said saturation direction and perpendicular to the plane of the wail, and said low-frequency magnetic alternating field passes through the saturated part of said container to form a stirrer field which provides the desired circulation in the melt.

2. A method according to claim 1, wherein in said step of applying a low-frequency magnetic alternating field, said low frequency is between 0.1 and 5 Hz.

3. A method of inductively stirring a molten metal contained in an essentially cylindrical container according to claim 1, wherein said magnetic field is applied essentailly along the axial axis of said cylindrical container, and said step of applying a low-frequency magnetic travelling alternating field produces both axially and radially directed magnetic field components which penetrate the saturated container wall.

4. A method of inductively stirring a molten metal contained in an essentially cylindrical container according to claim 2, wherein said magnetic field is applied essentailly along the axial axis of said cylindrical container, and said step of applying a low-frequency magnetic travelling alternating field produces both axially and radially directed magnetic field components which penetrate the saturated container wall.

5. A method according to claim 3, wherein said container is a crucible furnace and further comprising the step of supplying said crucible furnace with alternating current.

6. A device for carrying out stirring of a molten metal by means of inductive stirring, comprising:

a container for retaining molten metal and having a wall with a least one layer of a magnetic material, at least one coil for generating a magnetic direct field interacting with said magnetic material for causing an anisotropically directed magnetic saturation in at least a part of said wall, said magnetic direct field having a direction aligned with the direction of saturation and which is substantially oriented in the plane of said wall and directed essentially parallel to a desired stirring direction, a plurality of coils for generating a low-frequency magnetic travelling alternating field having components substantially located in a plane oriented parallel to said saturation direction and perpendicular to the plane of the wall, whereby the alternating field passes through the saturated part of the wall and creates a stirrer field in the molten metal in the form of a magnetic alternating field with components directed essentially parallel to and perpendicular to said saturation direction.

7. A device according to claim 6, wherein said plurality of coils generate a travelling alternating magnetic field with a frequency between 0.1 and 5 HZ.

8. A device according to claim 6, wherein said at least one coil is supplied with direct current.

9. A device according to claim 6, wherein said at least one coil is a permanent magnet.

10. A device according to claim 6, wherein said container is cylindrical.

11. A device according to claim 7, wherein said container is cylindrical.

* * * * *